US009643213B2

(12) United States Patent
Cady

(10) Patent No.: US 9,643,213 B2
(45) Date of Patent: May 9, 2017

(54) REVERSE CROWNED FILTER ASSEMBLY

(71) Applicant: M-I L.L.C., Houston, TX (US)

(72) Inventor: Eric Cady, Florence, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/316,129

(22) Filed: Jun. 26, 2014

(65) Prior Publication Data

US 2015/0375266 A1 Dec. 31, 2015

(51) Int. Cl.
*B07B 1/28* (2006.01)
*B07B 1/46* (2006.01)
*B07B 1/48* (2006.01)

(52) U.S. Cl.
CPC ..... *B07B 1/28* (2013.01); *B07B 1/4609* (2013.01); *B07B 1/4663* (2013.01); *B07B 1/48* (2013.01); *B07B 1/4618* (2013.01); *B07B 2201/02* (2013.01)

(58) Field of Classification Search
CPC .. B01D 46/0075; B01D 33/803; B01D 33/00; B01D 33/00003; B01D 33/0093; B07B 1/46; B07B 1/4645; B07B 1/4609; B07B 1/28; B07B 2201/02; B07B 1/4663; B07B 1/469; B07B 1/4672; B07B 1/48; B07B 1/4618; B07B 1/4654; E21B 21/065; E21B 21/06
USPC ..... 209/254, 269, 274, 397, 401
See application file for complete search history.

(56) References Cited

U.S. PATENT DOCUMENTS 5,927,511 A * 7/1999 Riddle ..... B01D 33/0376 209/405
5,944,197 A * 8/1999 Baltzer ..... B01D 33/0093 209/400
7,150,358 B2 12/2006 Carr et al.
2002/0175111 A1 11/2002 Crabbe et al.
2004/0007508 A1* 1/2004 Schulte, Jr. ..... B01D 29/012 209/403
2005/0258080 A1* 11/2005 Carr ..... B07B 1/46 209/399
2006/0108113 A1* 5/2006 Scott ..... B01D 33/0376 166/255.1
2006/0163121 A1* 7/2006 Fisher ..... B01D 33/0376 209/399
2006/0180509 A1 8/2006 Burnett et al.
2008/0093268 A1* 4/2008 Hukki ..... B07B 1/4654 209/399

(Continued)

OTHER PUBLICATIONS

International Search Report and Written Opinion issued in related PCT application PCT/US2015/037064 on Sep. 8, 2015, 3 pages.

(Continued)

*Primary Examiner* — Krishnan S Menon
*Assistant Examiner* — Waqaas Ali
(74) *Attorney, Agent, or Firm* — David J. Smith

(57) ABSTRACT

Screen assembly for a vibrating separator, the screen assembly including a frame having a pair of parallel opposed sides and a pair of parallel opposed ends, a convex underside of the frame, a reverse-crowned top side of the frame opposed to the convex underside, and at least one screen cloth layer fixed to the top side of the frame for separating solid materials from liquids, where the deck of the vibrating shaker has a profile which is substantially planar or crowned.

17 Claims, 6 Drawing Sheets

(56) References Cited

U.S. PATENT DOCUMENTS

| | | | | |
|---|---|---|---|---|
| 2008/0105598 | A1 | 5/2008 | Fisher et al. | |
| 2009/0283454 | A1* | 11/2009 | Scott | B01D 33/0376 209/552 |
| 2009/0321328 | A1* | 12/2009 | Wodjciechowski | B07B 1/485 209/275 |
| 2013/0277282 | A1 | 10/2013 | Lipa et al. | |

OTHER PUBLICATIONS

M-I SWACO, "Vibratory Screens with Reverse Crown", Mar. 21, 2014, 1 page.

* cited by examiner

REVERSE CROWNED FILTER ASSEMBLY

BACKGROUND OF THE INVENTION

The statements in this section merely provide background information related to the present disclosure and may not constitute prior art.

Embodiments disclosed herein relate generally to apparatus and methods for treating subterranean formations, in particular, to oilfield shakers and sifting screens.

Separation equipment is used in multiple industries to separate one type or sized component from another sized or type component. For example, in the pharmaceuticals industry separation can be used to separate solid particles of a certain size/composition from particles of a different size/composition. In the oilfield industry, separation equipment can be used to separate wellbore fluid (e.g. drilling fluid, loss circulation material, completion fluid, hydrocarbons and etc.) from solid cuttings or other fluid.

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Drilling mud provides a column of hydrostatic pressure, or head, to prevent "blow out" of the well being drilled. This hydrostatic pressure offsets formation pressures thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and re-pumped down through nozzles of the drill bit, the cutting particulates must be removed.

One type of apparatus used to remove cuttings and other solid particulates from drilling fluid is commonly referred to in the industry as a "shale shaker." A shale shaker, also known as a vibratory separator, is a vibrating sieve-like table upon which returning solids laden drilling fluid is deposited and through which substantially cleaner drilling fluid emerges. Typically, the shale shaker is an angled table with a generally perforated filter screen bottom. Returning drilling fluid is deposited at the feed end of the shale shaker. As the drilling fluid travels down the length of the vibrating table, the fluid falls through the perforations to a reservoir below thereby leaving the solid particulate material behind. The vibrating action of the shale shaker table conveys the solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of this disclosure.

The amount of vibration and the angle of inclination of the shale shaker table are adjustable to accommodate various drilling fluid flow rates and particulate percentages in the drilling fluid. After the fluid passes through the perforated bottom of the shale shaker, it may either return to service in the borehole immediately, be stored for measurement and evaluation, or pass through an additional piece of equipment (e.g., a drying shaker, a centrifuge, or a smaller sized shale shaker) to remove smaller cuttings and/or particulate matter.

DRAWINGS

The drawings described herein are for illustrative purposes only of selected embodiments and not all possible implementations, and are not intended to limit the scope of the disclosure.

Figure 4A:
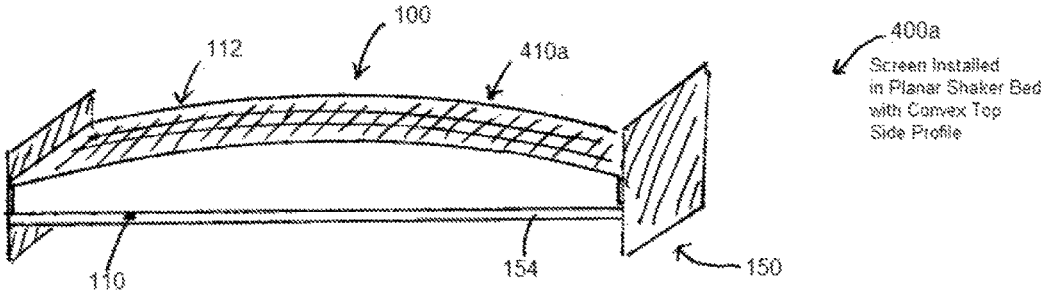
Figure 4B:
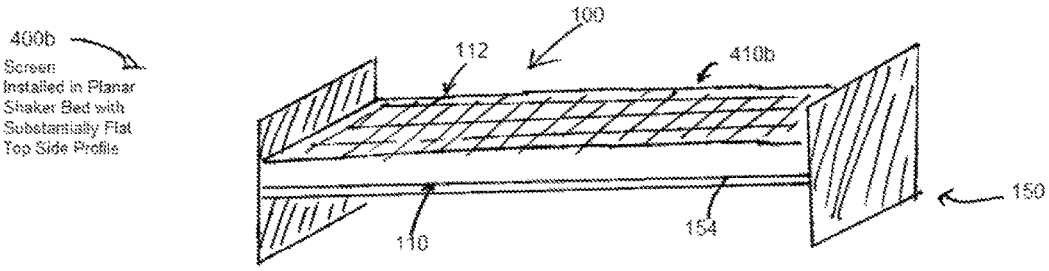

FIGS. 4*a* and 4*b* are perspective views of a planar deck with a reverse-crowned screen assembly installed thereon, the screen assembly having convex or substantially flat top sides.

Figure 5:
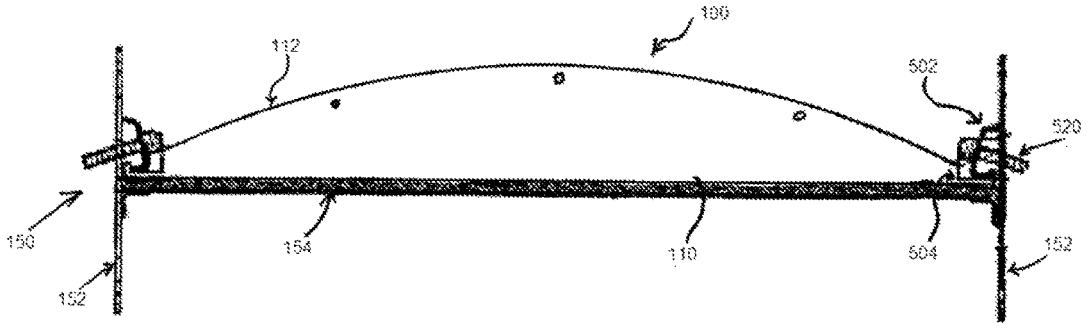

FIG. 5 is a plan view of a planar deck with a reverse-crowned screen assembly installed thereon, the screen assembly secured with T bolts.

Figure 6:
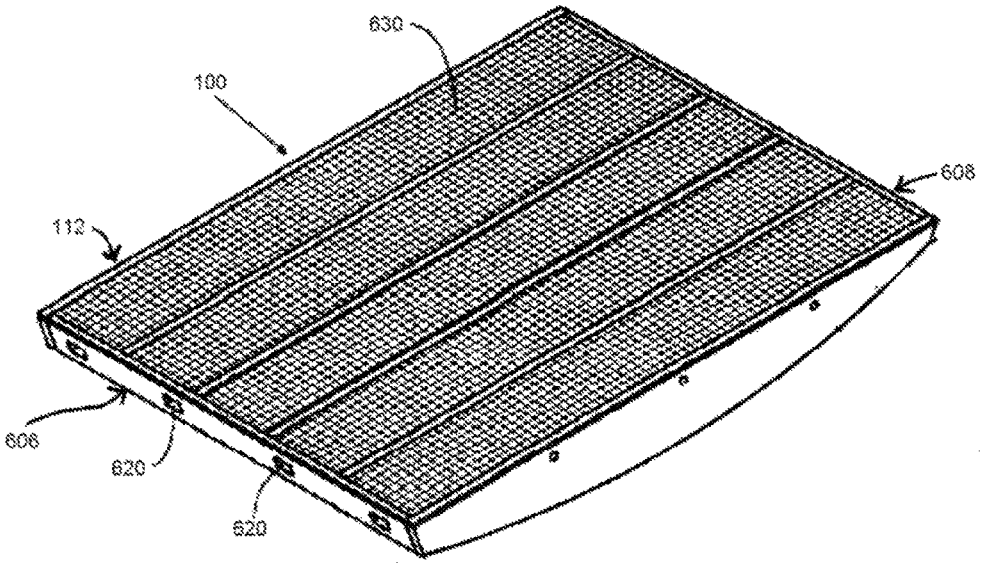

FIG. 6 is a perspective view of a reverse-crowned screen assembly with a screen layer tensioned upon the top side of the frame.

Figure 7:
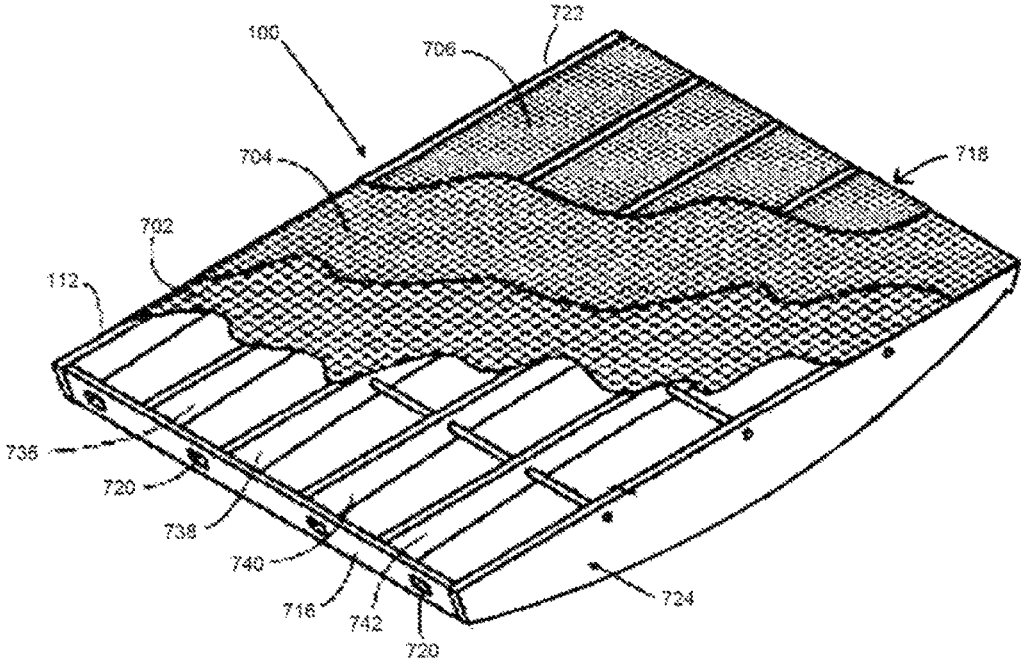

FIG. 7 is a perspective view of a reverse-crowned screen assembly with three screen cloth layers bonded and tension to the top side of the frame.

Figure 8:
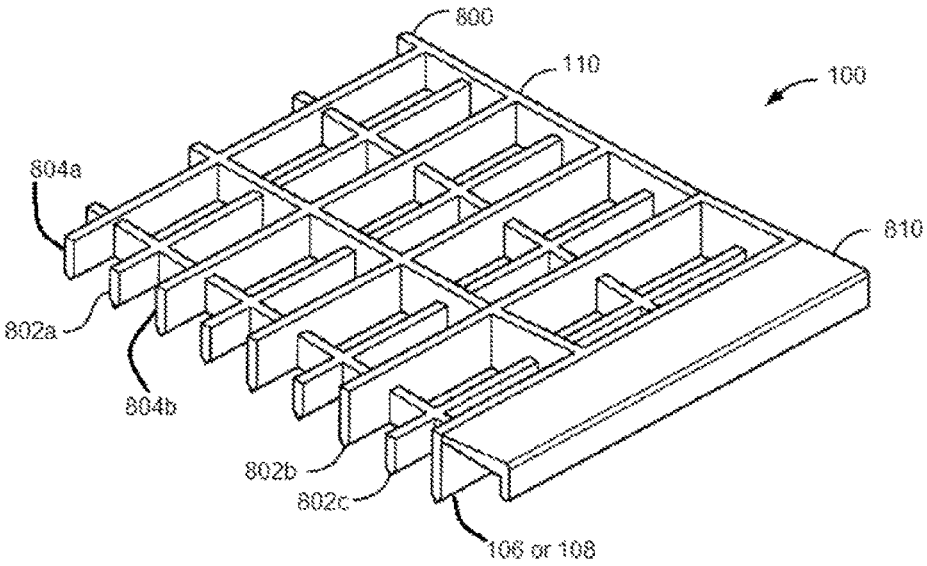

FIG. 8 is a perspective view of a reverse-crowned screen assembly which includes a hookstrip.

Figure 9:
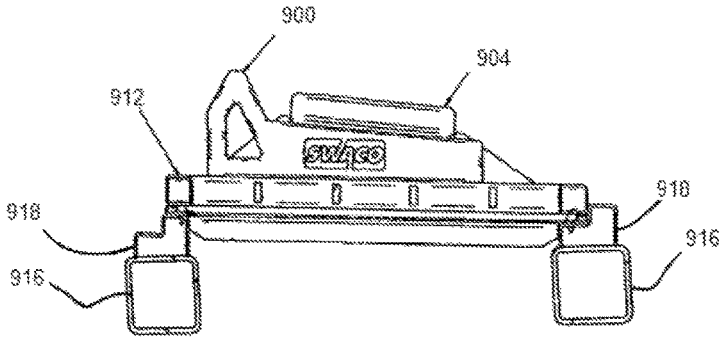

FIG. 9 is a plan view of a deck with a reverse-crowned screen assembly secured with wedge blocks.

Figure 10:
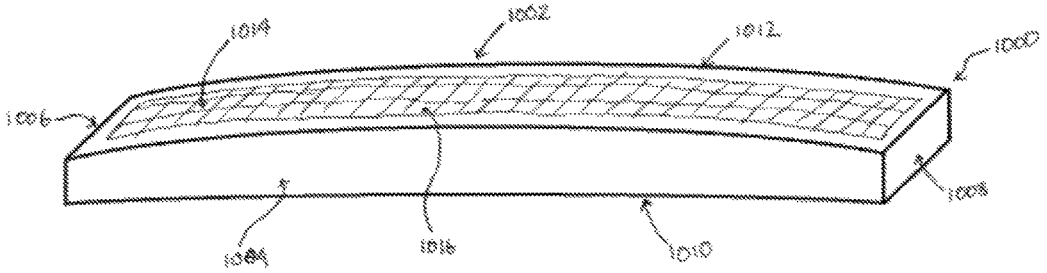

FIG. 10 is a perspective view of a reverse-crowned screen assembly in accordance with the principles of the disclosure.

Figure 11:
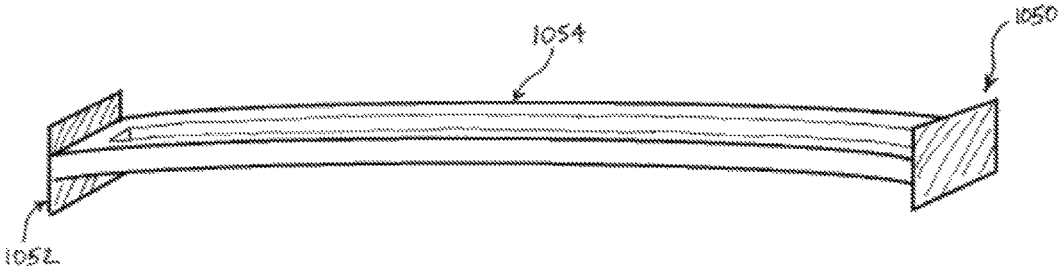

FIG. 11 is a perspective view of a crowned deck for a vibrating shaker, which receives a reverse-crowned screen assembly for installation, in accordance with the principles of the disclosure.

Figure 12:
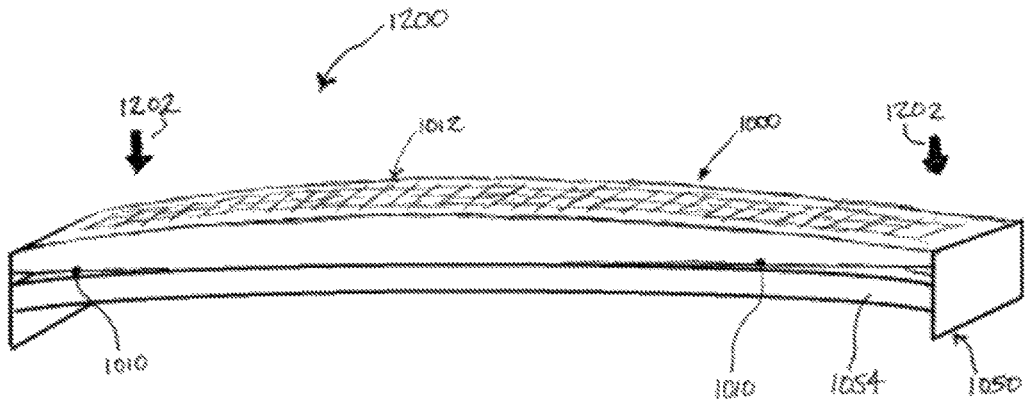

FIG. 12 is a perspective view of a crowned deck which receives a reverse-crowned screen assembly.

Figure 13:
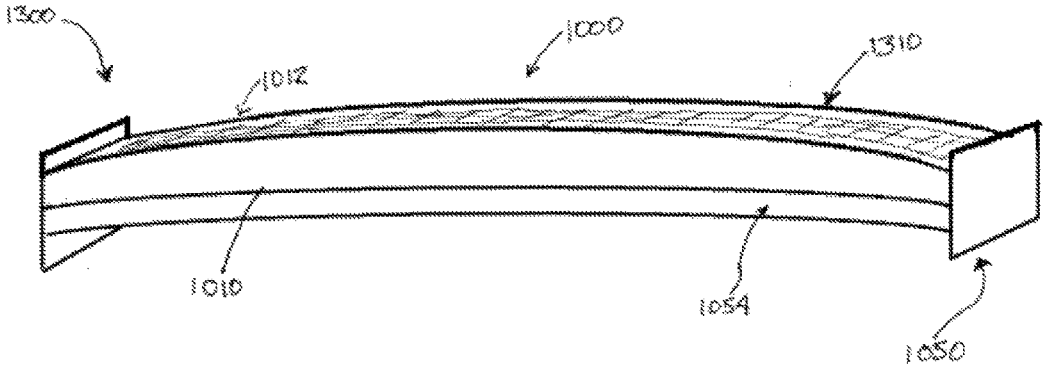

FIG. 13 is a perspective view of a crowned deck with a reverse-crowned screen assembly installed thereon.

DETAILED DESCRIPTION

Embodiments disclosed herein are applicable to separation devices that may be utilized in numerous industries, such as vibratory separators. While specific embodiments may be described as utilized in the oilfield industry, such as use with shale shakers, the device may be applicable in other industries where separation of liquid-solid, solid-solid and other mixtures may require separation. The embodiments, for example, may be utilized in the mining, pharmaceutical, food, medical or other industries to separate such mixtures.

Example embodiments will now be described more fully with reference to the accompanying drawings. At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited.

In the following detailed description, reference is made to accompanying drawings, which form a part hereof. In the drawings, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined and designed in a wide variety of different configurations, all of which are explicitly contemplated and form part of this disclosure.

Embodiments described herein relate to vibratory separator screens and installing the screens onto screen deck beds in shakers. In some embodiments, composite screen assemblies have a reverse-crown (also referred to as convex) profile on the bottom side. Such a screen assembly may be installed and secured onto screen beds, that are substantially planar or crowned, which may result in improved shaker manufacturing efficiency, and even provide improved screen performance, life, and sealing. In those embodiments where the screen assembly has a composite frame, molding a reverse-crown frame may result in improved consistency and reduced variation amongst several molded screen frames, as compared with the consistency and variation in manufacturing several shaker screen beds.

Vibratory separators may have deck beds which are substantially planar or in other cases, crowned. When crowned, the crowning profile may be very subtle with a very large radius, up to sharply crowned with a smaller radius. No specific degree of crowning is required according to the disclosure, and the requisite amount of crowning will be readily apparent to those of skill in the art. The terminology 'substantially planar' and 'planar' as used herein, means a surface, or area encompassed or encircled by surface, which is level, or intended to be level; however it will be appreciated that in the manufacture and use of planar geometric surfaces or areas, minor inconsistencies in the plane can occur or evolve. While intended to be completely level, the surface may be substantially level, which is also included within the meaning of this terminology.

In some embodiments, the reverse-crown surface profile of the screen assemblies may be very subtle, or even visually unperceptive, while in other embodiments the profile may be visually apparent. While the disclosure is not limited to any particular amount of reverse-crowning, some non-limiting ranges of reverse-crowning deemed suitable in operation include, up to 2 inches of rise from a flat plane, from 0.1 inch to 1 inch from a flat plane, or even from 0.25 inch to 0.75 inch from flat plane. Also, the reverse-crowning may be symmetrical across the width of the screen assembly, or asymmetrical.

Figure 1:
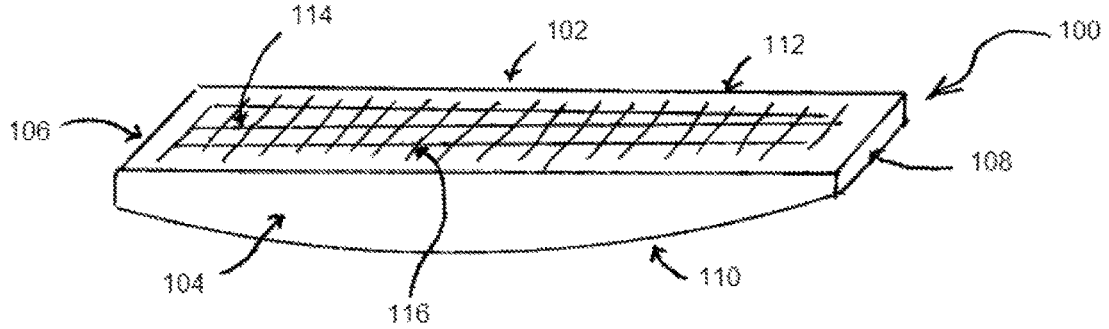
FIG. 1 is a perspective view of a reverse-crowned screen assembly in accordance with the principles of the disclosure.
Figure 2:
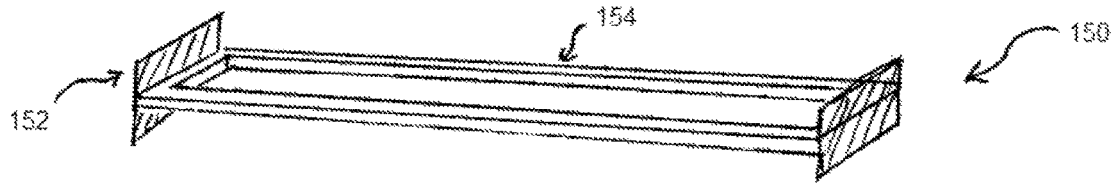
FIG. 2 is a perspective view of a planar deck for a vibrating shaker, which receives a reverse-crowned screen assembly for installation, in accordance with the principles of the disclosure.

Referring to FIGS. 1 and 2, according to some embodiments of the disclosure, reverse-crowned screen assemblies 100 for installation on vibrating separators having a planar deck 150 are illustrated. The screen assembly 100 includes a frame having a pair of parallel opposed ends, 102, 104, and a pair of parallel opposed sides, 106, 108. The frame has a convex underside 110 to form the bottom of the reverse-crowned screen assembly 100, and a top side 112 opposed to the convex underside 110. At least one screen cloth layer may be fixed to the top side 112 of the frame for separating solid materials from liquids when installed and utilized in the vibratory shaker.

Figure 3:
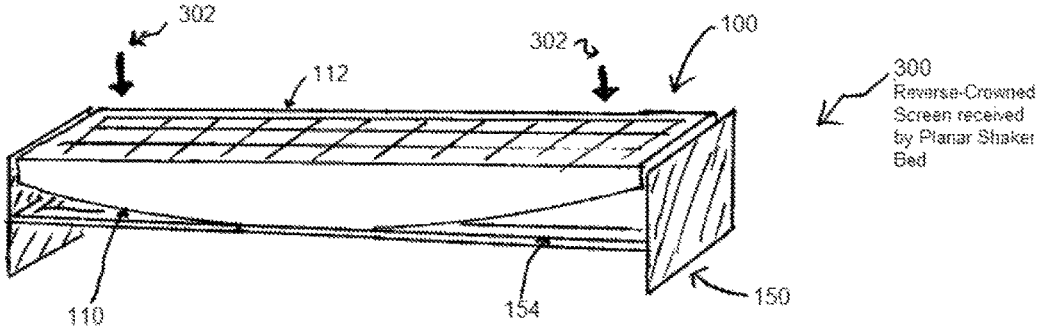
FIG. 3 is a perspective view of a planar deck which receives a reverse-crowned screen assembly.

Referring to FIG. 3, in some other embodiments, the disclosure provides a reverse-crowned screen assembly 100 for attachment to a planar deck 150 of a vibrating shaker, the screen assembly 100 having a screen frame including a convex underside 110 and a top side 112. After being received by the planar deck 150, the screen assembly 100 is installed on the planar deck 150 and flexes upon application of force, as depicted by bold arrows 302. Now referring to FIGS. 4*a* and 4*b*, after application of force and subsequent flexing, the convex underside 110 of screen assembly 100 adapts to the planar profile of the planar deck bed 154 while the top side 112 forms to a profile 410. Further, at least one screen mesh may be attached to the top side 112 of the screen assembly.

Referring again to FIGS. 4*a* and 4*b*, after installation and application of force 302 to tension the screen assembly 100, top side 112 profile 410 may be any suitable shape. For example, FIG. 4*a* illustrates a convex profile 410*a* for top side 112, while FIG. 4*b* illustrates a substantially flat profile 410*b* top side 112. In practice, if the pre-installation radii of the profile of convex underside 110 and top side 112 are substantially equal, the top side 112 may be substantially planar after installation the screen assembly 100 into planar deck 150, as shown in FIG. 4*b*. If, however, the pre-installation radius of the convex underside 110 is greater than the radius of the top side 112, then after installation, the top side 112 profile 410 may be curved upward or convex, as depicted in FIG. 4*a*. In some other cases, if the radius of the convex underside 110 is smaller than the radius of the topside 112, then upon installation, the top side 112 may be curved downward, or concave, which results in a U-shaped channel in the center.

Referring again to FIG. 1, reverse-crowned screen assembly 100 may include a plurality of cross supports 114 extending between the opposed sides, 106, 108, and substantially parallel to the opposed ends, 102, 104, where at least some of the cross supports 114 have a convex underside. In some cases, the reverse-crowned screen assembly 100 may further include one or more of braces 116 extending perpendicularly between the cross supports 114.

Now referencing FIG. 5, which illustrates an end view of a reverse-crowned screen assembly 100 installed on a planar deck bed 150, in accordance with some embodiments of the disclosure. The underside 110 of the screen assembly is received on planar deck bed 154. In some embodiments, the planar deck bed has a draw bar 502 with tensioning bolts 520. The screen assembly 100 is placed on the deck bed 154 and a hook end 504 of screen assembly 100 is underneath the draw bar 502. As the tension bolts 520 are tightened, the screen assembly 100 is pulled towards the planar deck bed side wall 152 and stretched by the draw bar 502 across the planar deck bed 154. As the stretching occurs, the underside 110 of the screen assembly 110 may be further secured to the planar deck bed 154. While FIG. 5 depicts a convex, or upward curved profile, of top side 112, this is in no way limiting, and the post installation screen tensioned top side 112 profile could be any suitable profile, including substantially flat or a U-shaped channel, as well, and such variations in top side profile is within the scope of any screens in according with the disclosure.

FIG. 6 illustrates yet other embodiments where the reverse-crowned screen assembly 100 includes a plurality of openings 620 through the frame opposed sides, 606, 608, in order to receive the bolts therethrough and further secure the screen assembly 100 in a shaker planar screen bed. FIG. 6 also shows that a screen layer 630 is tensioned to the top side 112 of the screen assembly 100.

FIG. 7 illustrates some embodiments of the screen assembly 100 which include a plurality of screen cloths 702, 704, and 706, affixed to the top side 112 of the screen assembly 100 and tensioned thereon. FIG. 7 shows the screen cloths partially cut-away for clarity. In some cases, a coarse backing layer 702 will mate with the frame, a fine middle layer 704 will be placed thereover, and a fine top layer 706 will go on top of the middle layer 704. The screen cloths are stretched and tensioned to the frame and then affixed with epoxy or other suitable adhesive. It will also be appreciated that a lesser or greater number of screen cloths might be used, and that any suitable arrangement of screen cloth mesh size may be used as readily apparent to those of skill in the art.

FIGS. 6 and 7 illustrate where in some embodiments, opposed frame sides, 606, 608, 716, 718, of the screen assembly 100 are chamfered at the underside to accommodate the T-head bolts, prior to insertion into and through the slot, 620 and 720, in those cases where such securing mechanism is utilized. In other words, the heads of the bolts will reside in the space chamfered away while the screen assembly 100 is lowered onto the deck bed 154. Each chamfered end may further include a gasket in order to seal the screen assembly 100 with the sidewall of the vibrating shaker.

FIG. 7 further illustrates embodiments where reverse-crowned filter assembles include a pair of parallel, opposed ends, 722 and 724, and a pair of parallel, opposed sides 716 and 718. The ends may longer than the sides to form an elongated rectangle but it will be understood that other configurations, such as a square, are possible within the scope of the disclosure. In some other instances, the sides may be longer than the ends. A plurality of cross supports, 736, 738, 740 and 742, extend between the sides, 716 and 718, and are parallel to the ends, 722 and 724. The number of cross supports will vary with the size and design and the invention is not limited to a particular number of cross supports.

FIG. 8 illustrates another mechanism for further securing the reverse-crowned screen assembly in the shaker planar screen bed, which is a hookstrip. The perspective illustration in FIG. 8 shows screen assembly 100 in an upside down orientation. Embodiments utilizing such a securing mechanism may include a screen assembly 100 having a hookstrip 810 attached or formed proximate the underside 110 at each of the opposed frame sides, 106 and 108, of the screen assembly 100, for example. FIG. 8 further illustrates embodiments where screen assembly 100 has a composite frame 800 formed which incorporates a plurality of ribs, 802*a*, 802*b* and 802*c*. Ribs 802*a*, 802*b* and 802*c*, may be of different lengths to provide a close grid for supporting filtering elements. Ribs may be of different lengths to provide an overall reverse-crowned profile; for example, rib 804*a* may have a greater length than rib 804*b*, and 804*b* may have a greater length than rib 802*b*, forming such profile.

Turning now to FIG. 9, screen assemblies according to the disclosure may also be secured to the vibratory shaker with wedge blocks 900. Some examples of suitable wedge blocks include those described in U.S. Pat. No. 7,150,358, which is incorporated herein by reference thereto. A wedge block retainer bracket 904 may also included. As should be noted by one of skill in the art, in some embodiments, the wedge block 900 has a width that is substantially similar to that of the wedge retainer bracket 904. It should also be noted the number of wedge blocks may vary from one to eight or more depending upon the design of the vibratory shaker, the size and positioning of the wedge block and wedge block retainer bracket relative to each other as well as other factors that should be well known to one of skill in the art. Further illustrated in FIG. 9, the screen assembly 912 is held in place by the wedge block 900 working in frictional cooperation with the wedge block retainer bracket 904. The vibratory shaker may further include a supporting cross member 916 upon which a screen assembly support 918 is mounted.

While it has been illustrated above that screen assemblies may be secured by wedge blocks, hook strips, and T-head bolts, it will also be appreciated that other suitable mechanisms may be suitable for securing the screen assemblies into the vibratory shaker, such as pneumatic actuators, and the like, or any other mechanism readily known to those of skill in the art.

Now referring to FIGS. 10 and 11, which illustrate some other screen embodiments of the disclosure. While the screens graphically illustrated in FIGS. 1 through 5 are shown installed onto a planar deck, the reverse-crowned screen assemblies may also be useful for installation on vibrating shakers having a crowned or concave deck, such as 1050 shown in FIG. 11. In FIG. 10, the screen assembly 1000 includes a frame having a pair of parallel opposed ends, 1002, 1004, a pair of parallel opposed sides, 1006, 1008, a concave or flat underside 1010, and a top side 1012 opposed to underside 1010. At least one screen cloth layer may be fixed to the top side 1012 of the frame for separating solid materials from liquids when installed and utilized in the vibratory shaker. Deck 1050 includes sidewalls 1052 and crowned deck bed 1054.

Referring to FIG. 12, reverse-crowned screen assembly 1000 for attachment to a crowned deck 1050 of a vibrating shaker, the screen assembly 1000 having a screen frame including a convex underside 1010 and a top side 1012. After being received by deck 1050, the screen assembly 1000 is installed onto deck bed 1054 and flexes upon application of force, 1202. Referencing FIG. 13, after application of force and subsequent flexing, the convex underside 1010 of screen assembly 1000 adapts to the crowned profile of deck bed 1054 while the top side 1012 forms to profile 1310. Further, at least one screen mesh may be attached to the top side 1012 of the screen assembly. After installation and application of force 1202 to tension the screen assembly 1000, top side 112 profile 1310 may be any suitable shape. In practice, if the pre-installation radii of the profile of underside 1010 and top side 1012 are substantially equal, the top side 1012 may be crowned at a similar radius as deck bed 1054 after installation. If, however, the pre-installation radius of the underside 1010 is greater than the radius of the top side 1012, then after installation, the top side 1012 profile 1310 has a radius less than the deck bed 1054, as depicted in FIG. 13. In some other cases, if the radius of the underside 1010 is less than the radius of the topside 1012, then upon installation, the top side 1012 has a profile with a radius greater than that of the deck bed 1054, or even substantially flat.

As with any other screen embodiments of the disclosure, screen assembly 100 may optionally include a plurality of cross supports 1014 extending between the opposed sides, 1006, 1008, and substantially parallel to the opposed ends, 1002, 1004. In some cases, the reverse-crowned screen assembly 100 may further include one or more of braces 1016 extending perpendicularly between the cross supports 1014.

Screen assembly frames according to the disclosure, may be formed from plastic, metal, metal alloy, or another suitable material having generally resilient properties when exposed to conditions present in the manufacture, delivery, installation and use of the reverse-crowned screen assembly frame. Some examples of plastics suitable for forming the frame include, but are not limited to: thermoset materials such as polyurethanes, polyesters, epoxy resins, polyimides, phenolic resins, phenol-formaldehyde resins, vulcanized rubber, melamine resin, and the like, or any suitable combination; thermoplastic materials such as polyethylene, polypropylene, polyamide, polyvinyl chloride (PVC), polystyrene, polyethylene-terephthalate, fluoropolymers, polybenzimidazole, poly(methyl methacrylate), and the like, or any suitable combination; and any suitable mixture of thermoplastic and thermoset materials.

When thermoset and/or thermoplastic materials are used to produce frame, other components may be added to the materials to achieve certain properties. For example, but not limited hereto, reinforcing fibers, such as boron, carbon, fibrous minerals, glass, Kevlar®, and the like may be incorporated to increase tensile strength, increase flexural modulus, increase heat-deflection temperature, and/or to resist shrinkage and warpage. Conductive fillers, such as aluminum powders, carbon fiber, graphite, and the like may be used to improve electrical and thermal conductivity. Coupling agents, such as silanes, titanates, and the like, may be incorporated to improve interface bonding between polymer matrix and the fibers. Extender fillers, such as calcium carbonate, silica, or clay, as well as plasticizers such as monomeric liquids, low-molecular-weight materials may be also incorporated to improve melt flow properties, enhance flexibility, and/or reduce material cost. Colorants (pigments and dyes), such as metal oxides, organic pigments, and/or carbon blacks to provides colorfastness and protect from thermal and UV degradation. Blowing agents, like gas, azo compounds, hydrazine derivatives, may be used to generates a proper material density. Other additives, known to those of skill in the art, may be utilized as well.

Any suitable method of manufacturing frame may be utilized. For example, in the processing of thermoplastic materials, suitable techniques include extrusion molding, extrusion blow molding, injection blow molding, injection molding, injection stretch blow molding, insert molding, machining, molding expanded polypropylene (EPP), molding expanded polystyrene (EPS), process cooling, rotational molding, thermoforming, vacuum forming, and the like. For processing of thermoset materials, suitable techniques include injection molding, reaction injection molding, pultrusion, resin transfer molding, SMC/DMC molding, compression molding, and the like. Some other methods of forming frame include three dimensional printing, casting, machining or stamping.

The foregoing description of the embodiments has been provided for purposes of illustration and description. Example embodiments are provided so that this disclosure will be thorough, and will fully convey the scope to those who are skilled in the art. Numerous specific details are set forth such as examples of specific components, devices, and methods, to provide a thorough understanding of embodiments of the disclosure, but are not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although various embodiments have been described with respect to enabling disclosures, it is to be understood the invention is not limited to the disclosed embodiments. Variations and modifications that would occur to one of skill in the art upon reading the specification are also within the scope of the invention, which is defined in the appended claims.

The following is claimed:

1. A screen assembly system comprising:
a screen assembly comprising:
a frame having a pair of parallel opposed sides and a pair of parallel opposed ends;
a convex underside of the frame;
a top surface of the frame opposed to the convex underside, wherein the top surface is substantially planar; and
at least one screen layer fixed to the top surface of the frame for separating solid materials from liquids; and
a deck comprising a deck bed that receives the screen assembly,
wherein a top side of the deck bed, contacting the convex underside of the frame is substantially planar.

2. The screen assembly system of claim 1 wherein the opposed ends of the frame have convex undersides.

3. The screen assembly system of claim 2,
wherein the screen assembly further comprises a plurality of cross supports extending between the opposed sides parallel to the opposed ends, and
wherein at least one of the cross supports has a convex underside.

4. The screen assembly system of claim 3 wherein the screen assembly further comprises a plurality of braces extending between the cross supports.

5. The screen assembly system of claim 1 wherein the deck is included in a vibrating separator comprising a plurality of shaker attachment members.

6. The screen assembly system of claim 5 wherein the vibrating separator includes a pair of sidewalls, wherein the shaker attachment members are T-head bolts which are retained by the sidewalls, and wherein the screen assembly includes a plurality of openings through the frame opposed sides in order to receive the bolts therethrough.

7. The screen assembly system of claim 1 wherein the screen assembly further comprises a hookstrip formed proximate the bottom side at each of the parallel opposed frame sides of the screen assembly.

8. The screen assembly system of claim 1,
wherein the deck is included in a vibrating separator, and
wherein the screen assembly is secured to the vibrating separator with wedge blocks, pneumatic actuators, or a combination thereof.

9. The screen assembly system of claim 1 including three screen cloth layers bonded to the top side of the screen assembly.

10. The screen assembly system of claim 1 wherein each of the opposed frame sides includes a chamfered end from the top side toward the convex underside.

11. A screen assembly system comprising:
a vibrating separator comprising a deck;
pretensioned screen assembly attached to the deck of the vibrating separator,
wherein the pretensioned screen assembly comprises a screen frame having a pair of parallel opposed sides, a pair of parallel opposed ends, a convex underside, and a top side, and
wherein the pretensioned screen assembly is attached to the deck of the vibrating separator such that the convex underside abuts a top side of the deck having a substantially planar deck bed profile and adapts to the substantially planar deck bed profile of the top side of the deck while the top side of the pretensioned screen assembly forms a profile; and
at least one screen layer attached to the top side of the pretensioned screen assembly.

12. The screen assembly system of claim 11 wherein the top side profile of the pretensioned screen assembly is substantially flat.

13. The screen assembly system of claim 11 wherein the top side profile of the pretensioned screen assembly is convex.

14. The screen assembly system of claim 11 wherein the at least one screen layer is tensioned to the top side of the pretensioned screen assembly.

15. The screen assembly system of claim 11 including three screen layers bonded and tensioned to the top side of the pretensioned screen assembly.

16. The screen assembly system of claim 11 wherein the vibrating separator includes a pair of sidewalls and attachment members retained by sidewalls, and wherein the pretensioned screen assembly includes a plurality of openings to receive the attachment members therethrough.

17. A method comprising:
providing a vibrating shaker comprising a deck bed;
providing a screen assembly, the screen assembly having a convex underside, a top side, and at least one screen layer attached to the top side of the screen assembly, wherein the top side forms a substantially planar shape;
placing the screen assembly upon the deck bed; and,
flexing the screen assembly by application of force such that the convex underside adapts to a deck bed profile while the top side forms to a profile; wherein the deck bed profile is substantially planar.

* * * * *